US006491494B1

(12) United States Patent
Beckenbach et al.

(10) Patent No.: US 6,491,494 B1
(45) Date of Patent: Dec. 10, 2002

(54) DIRECT DRIVE WATER PUMP

(76) Inventors: Clyde D. Beckenbach, 946 Macy St., West Palm Beach, FL (US) 33405; Rowland W. Wood, Jr., 16944 CR 252, McAlpin, FL (US) 32062

( * ) Notice: Subject to any disclaimer, the term of this patent is extended or adjusted under 35 U.S.C. 154(b) by 0 days.

(21) Appl. No.: 09/705,455

(22) Filed: Nov. 2, 2000

(51) Int. Cl.[7] ..... F01D 1/02
(52) U.S. Cl. ..... 415/206
(58) Field of Search ..... 415/191, 203, 415/204, 205, 206, 211.2, 230, 168.2; 416/185, 223 B

(56) References Cited

U.S. PATENT DOCUMENTS

RE24,909 E * 12/1960 Dochterman
5,205,725 A * 4/1993 Pattison ..... 417/423.3

* cited by examiner

*Primary Examiner*—Edward K. Look
*Assistant Examiner*—Kimya N McCoy
(74) *Attorney, Agent, or Firm*—Stokes Lawrence, P.S.

(57) ABSTRACT

A direct drive water pump is provided for circulating coolant in a high performance engine with or without a radiator. The direct drive water pump utilizes an electric motor that may be removed. The direct drive water pump utilizes removable flanges that provide for the use of the pump with multiple engines having various water passage configurations.

11 Claims, 4 Drawing Sheets

DIRECT DRIVE WATER PUMP

FIELD OF THE INVENTION

The present invention relates generally to a water pump for circulating coolant and, in particular, to the use of an electric motor and a plurality of blades on an impeller to increase coolant circulation in high performance engines.

BACKGROUND OF THE INVENTION

Internal combustions engines, such as those used in automobiles typically utilize a liquid cooling system to reduce the operating temperature of the engine and to increase engine performance. The liquid cooling system is conventionally composed of passages and chambers in the engine block and cylinder head had that are interconnected to allow the liquid to flow through these components to a radiator consisting of small tubes in cooperation with a honeycomb structure of fins to facilitate heat exchanging to cool the liquid. The liquid is typically water with ethylene glycols added to increase the boiling temperature and lower the freezing point of the water. To facilitate the movement of the water in the cooling system, a centrifugal-type pump driven by a belt, chain or gears in cooperation with the rotation of the engine crankshaft. Furthermore, to facilitate the heat exchange, a fan is utilized to draw cooler air through the radiator.

In high performance engines, such as those used in street rods, muscle cars and racecars typically operate at higher temperatures due to the increased horsepower and operating temperatures of the engine. These types of engines require more large cooling systems, such as increased volume radiators and fans. However, the size of the cooling system may be limited by the size of the engine compartment and often race sanctioning bodies such as the National Association for Stock Car Auto Racing ("NASCAR"), National Hot Rod Association ("NHRA"), Formula One, Champion Auto Racing Teams, Inc. ("CART") and others, often limit the volume of coolant allowed in the engine and radiator systems. Moreover, some engine builders and race mechanics may limit the amount of coolant used, or the size of the radiator in an attempt to reduce the weight of the vehicle. Often, engine builders fill a portion of the coolant passages to increase the strength of the engine block.

The flow of coolant through the engine block, cylinder heads and radiator, is controlled by the volumetric output of the coolant pump and, with conventional crank driven pumps, engine speed measured in revolutions per minute (RPM). These types of pumps are composed of a gear mechanism in the pump housing that is rotated by a belt driven off of the crankshaft. Therefore, the greater the RPM of the engine, the faster the rotational speed of the pump gear which, in turn, increases the flow rate of the coolant. Even though these pumps are effective for high RPM situations, these pumps are insufficient for low RPM situations such when the engine is at an idle or at low speeds.

In racing venues, it is common to see the engine mechanics using other methods to reduce engine temperatures while the engine is at idle or directly after running a race and in anticipation of the next pass. Racing sanctioning bodies often prohibit the use of the ethylene glycol in the cooling systems. Although the additive is effective at increasing the boiling point of water, it is extremely difficult to remove from concrete and asphalt and if spilled on the racing surface will cause a dangerously slippery racetrack. Besides eliminating additives, some racecars may not utilize a radiator, fan, or both in an attempt to decrease weight and eliminate load of the fan or pump paced on the engine. To minimize overheating, drag racers often tow the racecar by a tow vehicle to the staging lanes, starting line and from the finish line after the driver has shut down the engine. However, some racing classes do not allow tow vehicles and require the driver to drive the racecar to the staging lines and from the finish line. To control overheating, these types of racers, will position bags of ice on the engine intake manifold to assist in cooling the engine, spray water on the engine block or use large fans to blow cooler air at the engines. Although these methods may be effective in lowering the engine temperature, they are not practical in all racing situations and thus, method and system is needed to reduce engine temperatures in high performance engine, which do not take horsepower away from the engine.

SUMMARY OF THE INVENTION

The present invention provides a water pump for driving the coolant system of a high performance engine without reducing the horsepower of the engine. The water pump utilizes a direct drive system, which provides pump speeds that are independent of engine RPM. An electric motor is utilized to drive an impeller in the water pump, which is powered by a conventional 12-volt car battery or a 16-volt race battery. The impeller of the water pump has multiple blades to increase the flow rate of the pump.

The water pump of the present invention also provides a modular system that allows for the adaptation of a single motor and reservoir housing to be used on engines of varying sizes (i.e., big block and small block engines) and engines having unique coolant passageway locations by providing different shape and sized flanges that mount with the engine coolant passageway and the inlet of the impeller housing with coolant reservoir of the pump. This modular design also provides for easier access to the camshaft of conventional push-rod motors by allowing removability of the pump section while keeping the flanges attached to the motor.

DETAILED DESCRIPTION

Figure 1:
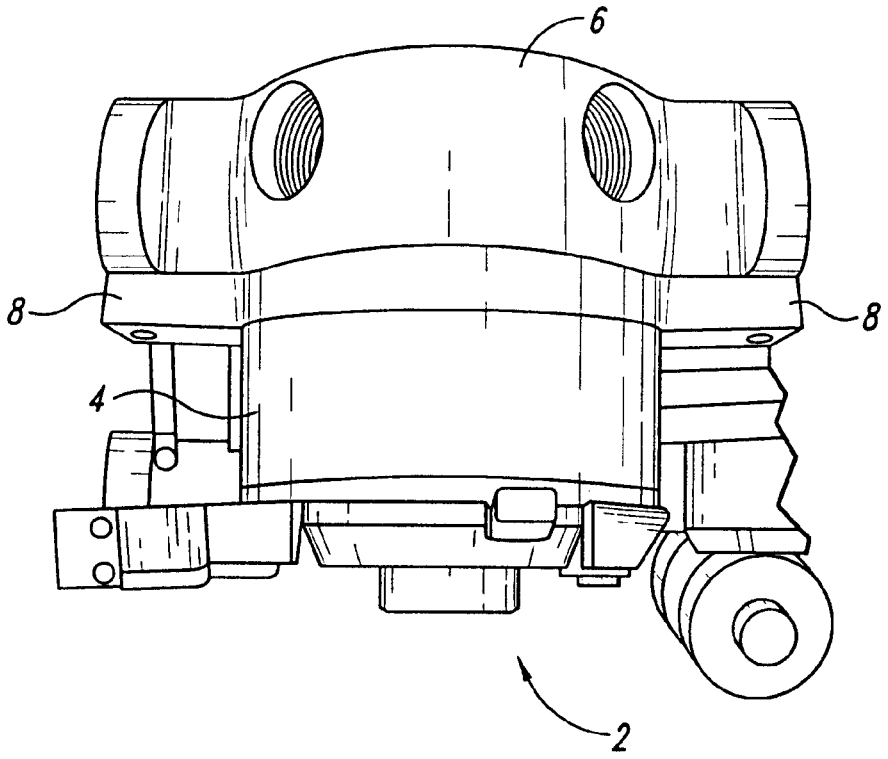
FIG. 1 is a perspective view of a direct drive pump.
Figure 2:
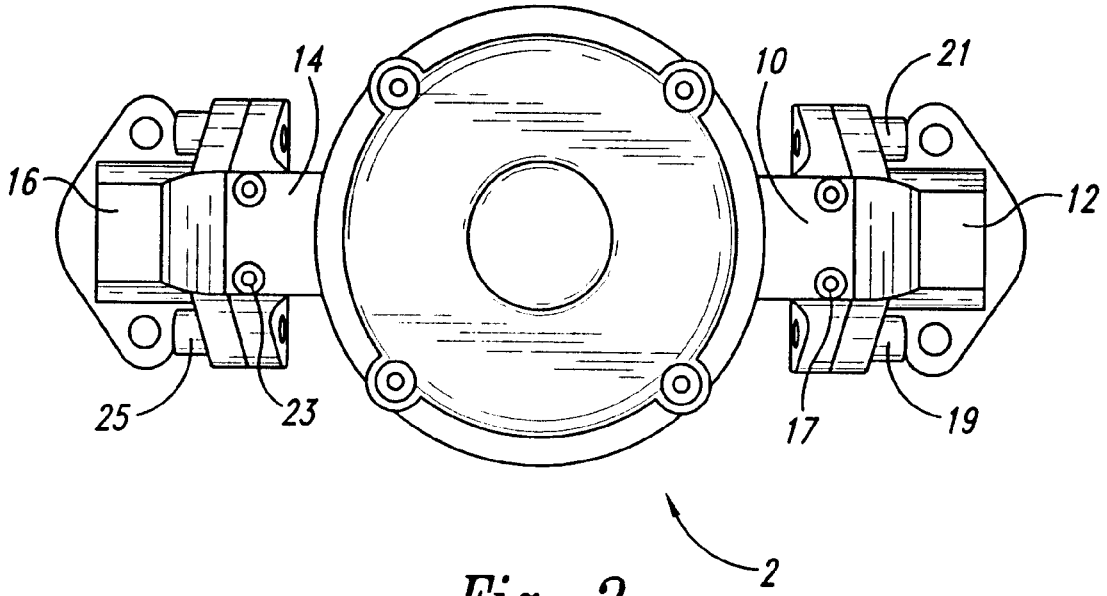
FIG. 2 is a bottom plan view of a direct drive pump with flanges for a big block Chevrolet style engine block.
Figure 3:
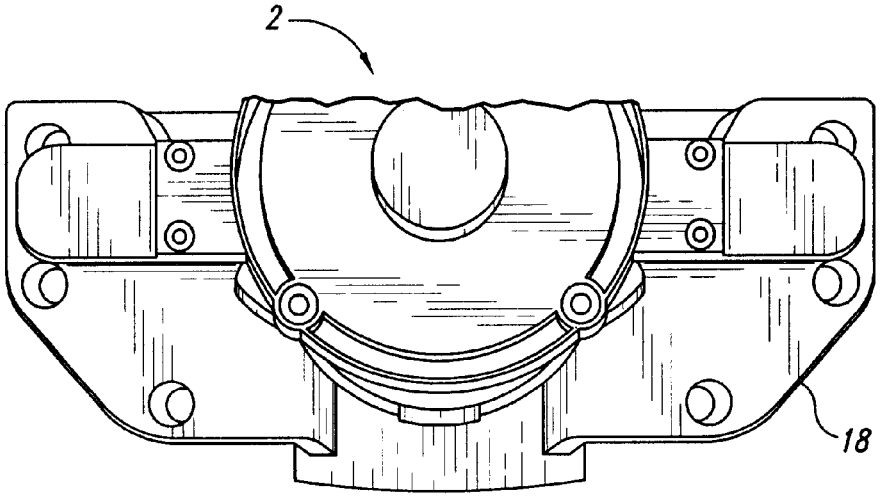
FIG. 3 is a partial bottom plan view of a direct drive pump with a single component flange assembly for a big block Chrysler style engine block.

The present invention may be more fully described with reference to FIGS. 1–7. FIG. 1 illustrates a direct drive pump 2 having a motor housing 4, an impeller housing with coolant reservoir 6, and a separation plate 8. FIG. 2 shows direct drive pump 2 as it would be positioned on the front of a big block Chevrolet engine block (not shown). Attached to an inlet 10 is a flange 12, which is mated to the engine block inlet, communicating with a coolant passageway in the engine block. Impeller housing with coolant reservoir 6 also has an outlet 14 and corresponding outlet flanges 16 complete the coolant fluid path to the engine block. Impeller housing with coolant reservoir 6, inlet 10, flange 12, outlet 14, and flange 16 are CNC machined out of billet 6061 aluminum. Mechanical fasteners 17, 19, 21, 23, and 25 are used to mate and hold flanges 12 and 16 to inlet 10 and outlet 14 of the coolant reservoir 6. Turning to FIG. 3, direct drive pump 2 is shown with an adapter flange assembly 18 for a big block Chrysler engine (not shown). Adapter flange assembly 18 combines both the inlet and outlet flanges to a single component for easier installation and to conform to the original centrifugal style pump mounting.

Figure 4:
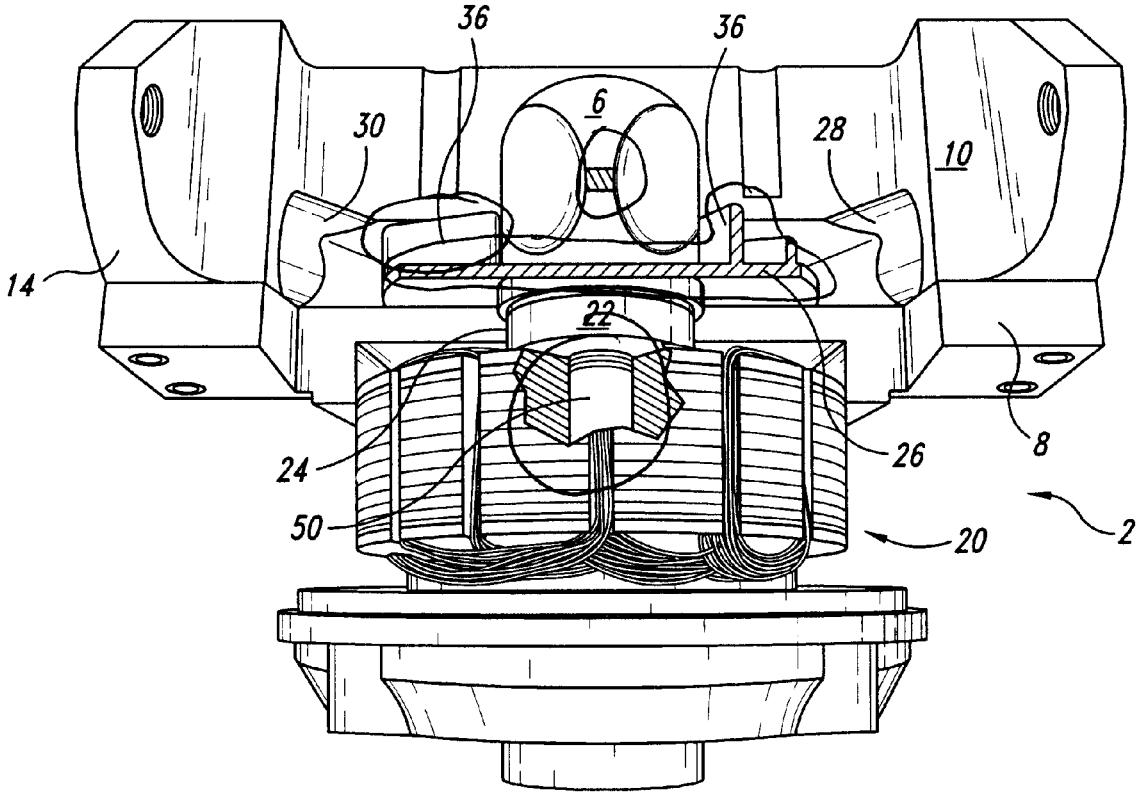
FIG. 4 is a cutaway view of the direct drive pump illustrating the electric motor, shaft, impeller housing with coolant reservoir and separation plate.
Figure 5:
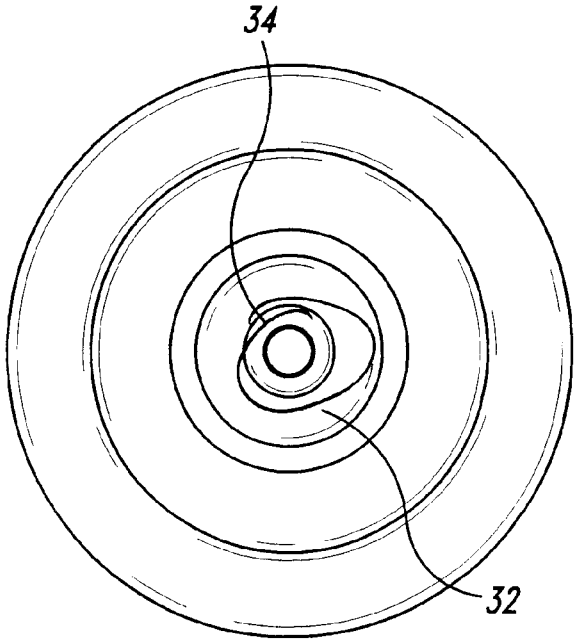
FIG. 5 is a plan view of an impeller showing a ceramic insert and a threaded boss.
Figure 6:
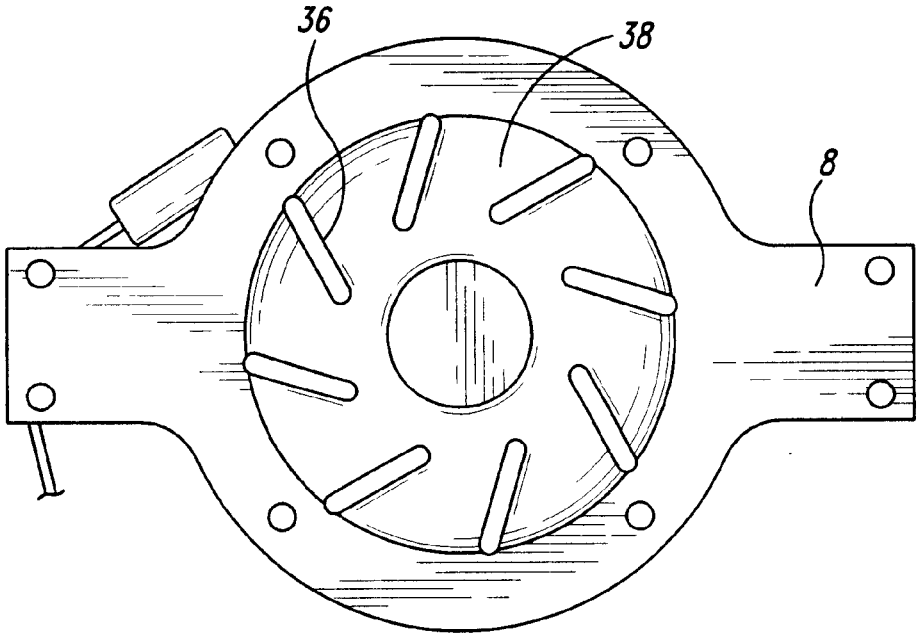
FIG. 6 is a plan view of an impeller mounted on a motor housing illustrating a plurality of blades for moving coolant.
Figure 7A:
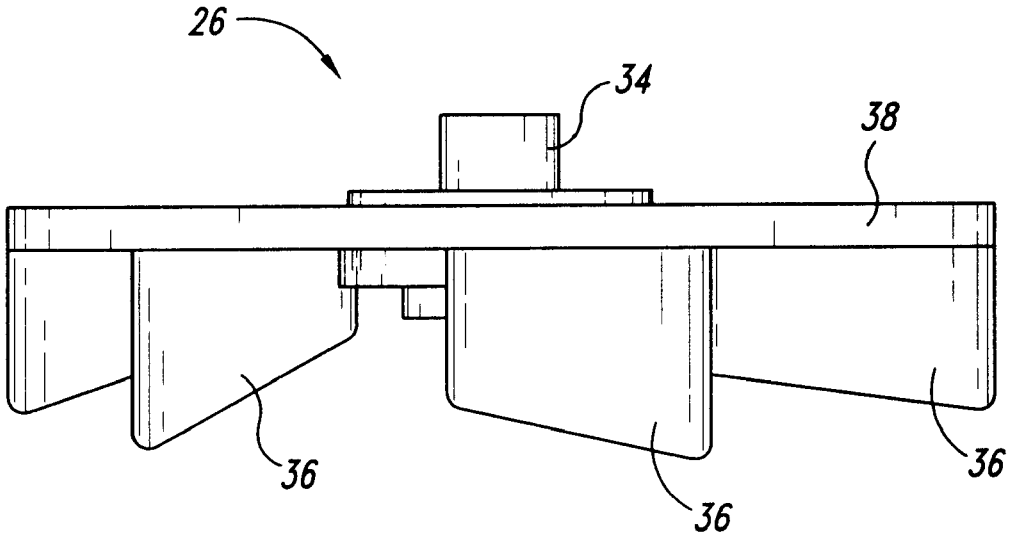
FIG. 7A is a side plan view of the impeller showing the threaded boss and the blades.
Figure 7B:
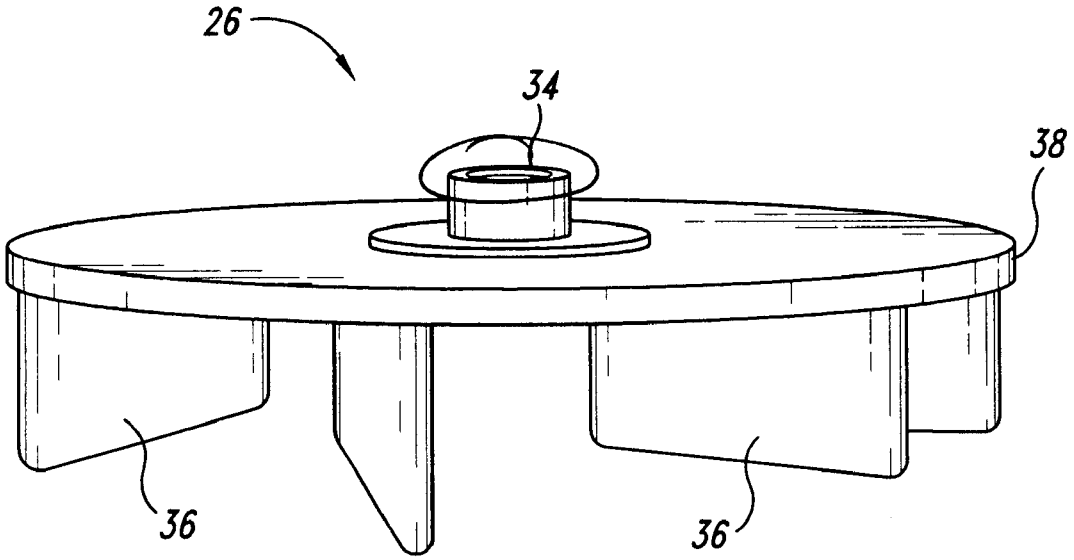
FIG. 7B is a perspective view of FIG. 7A.
Figure 1:
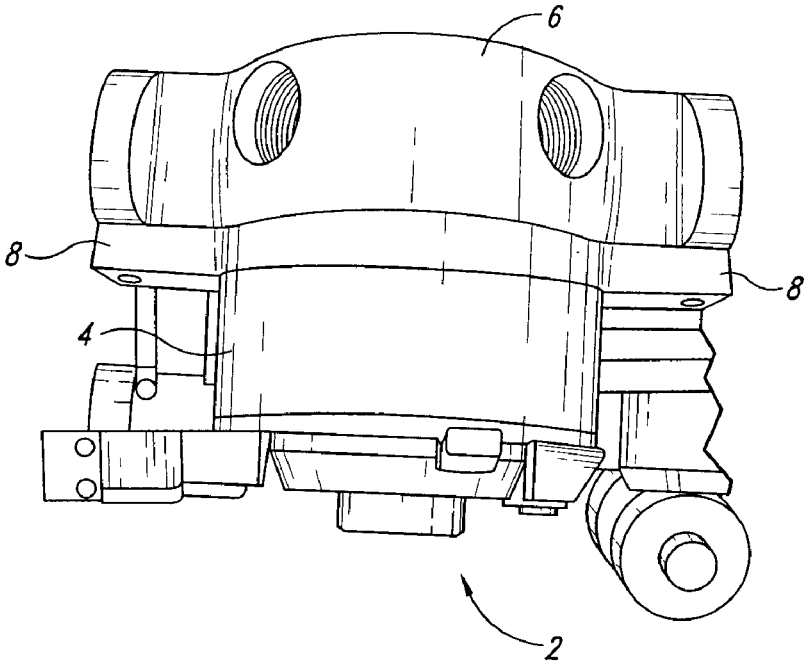
Figure 2:
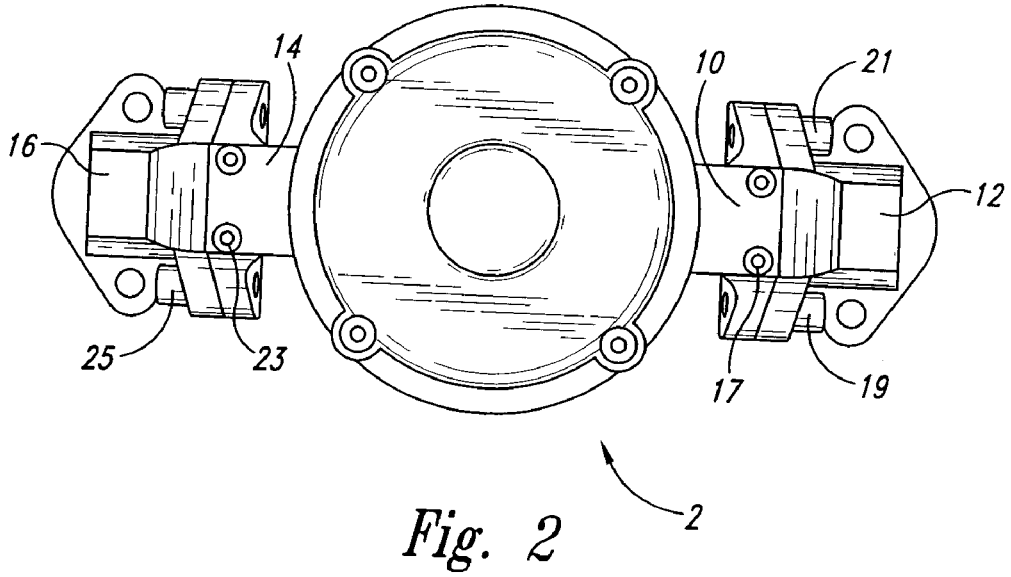
Figure 3:
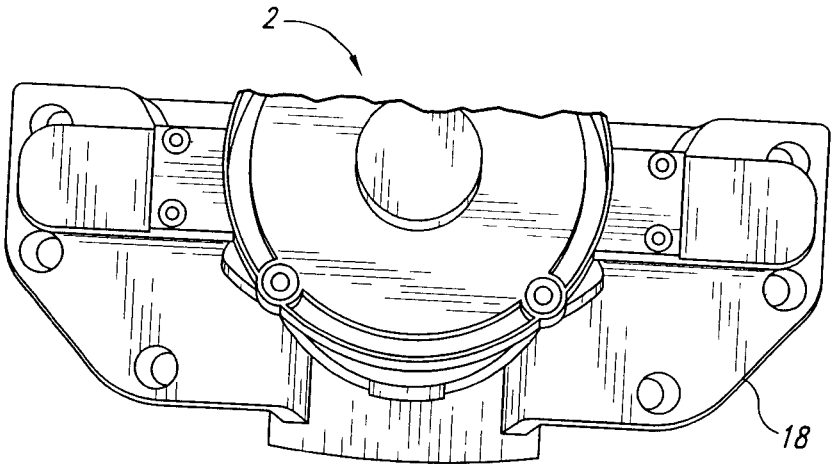
Figure 4:
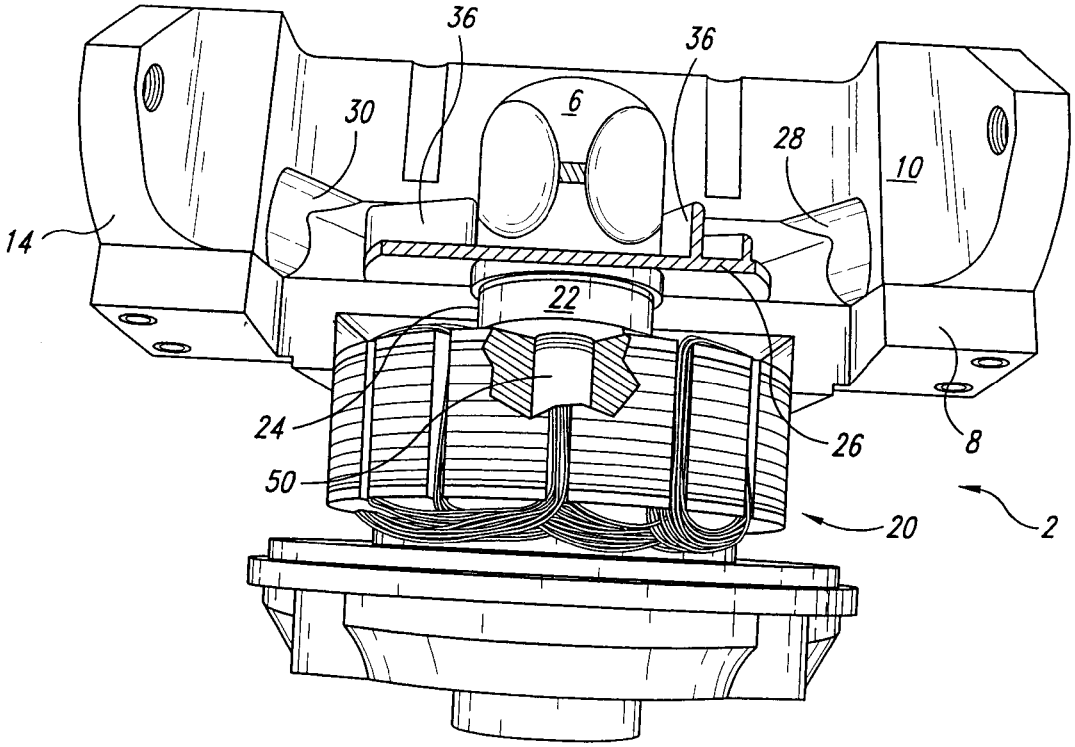
Figure 5:
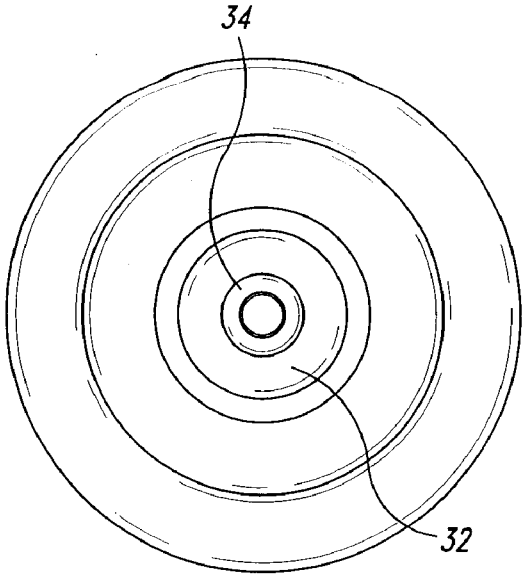
Figure 6:
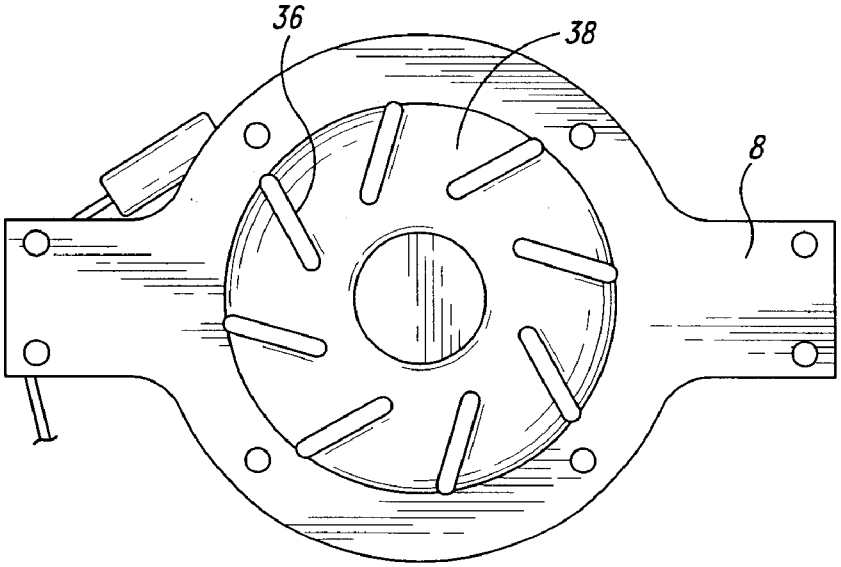
Figure 7A:
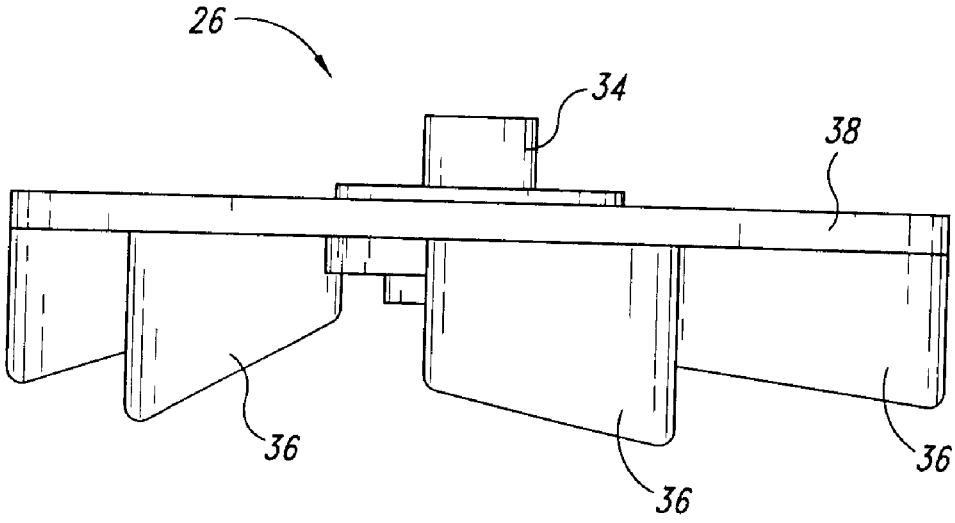
Figure 7B:
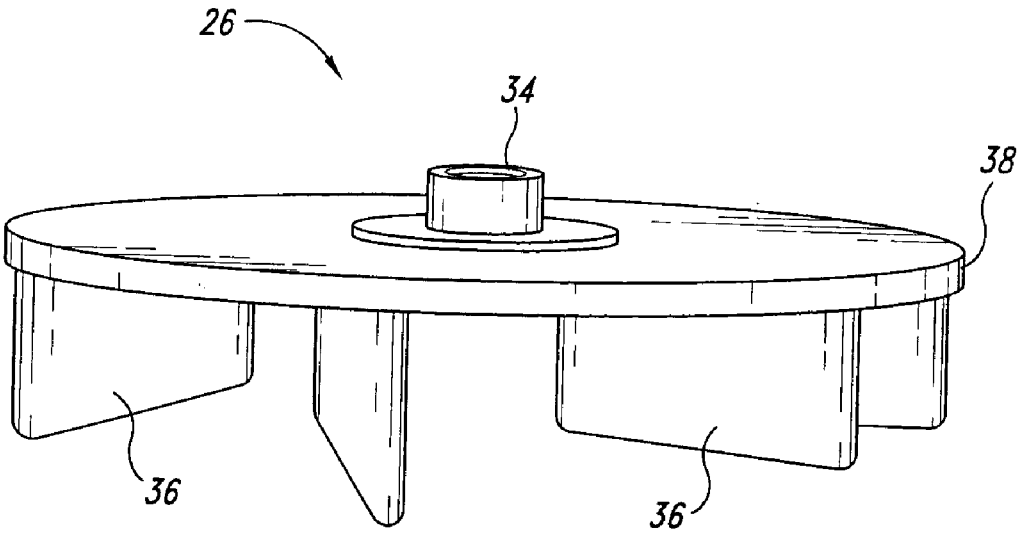

The internal components of direct drive pump 2 are shown in the cutaway of FIG. 4. Motor housing 4 has been removed to reveal an electric motor 20. Positioned above electric motor 20 is separation plate 8, which mates with motor housing 4 (not shown) to prevent coolant from entering motor housing 4. A sealing member 22 is positioned in a circular aperture 24 within separation plate 8. A shaft 50 driven by electric motor 20 extends through sealing member 22 and is rotated by electric motor 20. Above separation plate 8 is an impeller 26 machined from billet aluminum. The impeller mates with sealing member 22.

Returning to the impeller housing with coolant reservoir 6 shown in FIG. 4, inlet 10 and outlet 14 open to channels 28 and 30, respectively. As seen in the figure, the interior surfaces of channels 28 and 30 are directed at an angle to impeller 26 to increase coolant flow. It should be noted that direct drive pump 2 may have multiple inlets and outlets as required for various style coolant passageways of particular engine blocks and cooling paths leading to a radiator or collector.

Impeller 26 has a ceramic insert 32 (FIG. 5) which mates with sealing member 22. Extending from ceramic insert 32 is a boss 34 having internal threads. The shaft from electric motor 20 is received in threaded boss 34. This configuration eliminates the need for a lateral opening in boss 34 and a set-screw positioned through the opening for holding the shaft to impeller 26. Threaded boss 34 and impeller 26 thereby prevent coolant from entering motor housing 4.

Impeller 26 has blades 36 mounted on the face member 38 (the non-boss surface of impeller 26). To increase the flow rate of fluid, each blade 36 is positioned at a slightly forward angle, approximately 17 degrees. Fluid trial tests have shown that this slightly forward position increases coolant flow rate from 30 gallons per minute to 37 gallons per minute.

What has been described is merely illustrative of the application of the principles of the present invention. Other arrangements and methods may be implemented by those skilled in the art without departing form the spirit of the present invention.

What is claimed is:

1. An operationally independent water pump for circulating coolant in a high performance engine having coolant passages, the water pump comprising:

an impeller having a face portion with a plurality of blades protruding perpendicular of the first side of the face portion and having a boss with threads, the boss protruding from the face member on the opposite side;

a shaft having a threaded end for mating with a threaded portion of the impeller;

an electric motor in a motor housing and operatively connected to the shaft to cause rotation thereof;

an impeller housing and coolant reservoir coupled with the motor housing for containing the impeller and coolant;

an inlet in the impeller housing and coolant reservoir forming a first channel for receiving coolant from the coolant passages; and an outlet in the coolant reservoir forming a second channel for sending coolant to the coolant passages.

2. The water pump in accordance with claim 1 wherein the plurality of straight blades on the impeller with a first end extending from a first location defined by a concentric circle about the center axis of the face member branching radially outward to with a second end at a location on the outer periphery of the face member to provide a surface to generate a flow of coolant when the impeller rotates.

3. The water pump in accordance with claim 2 wherein the plurality of straight blades are positioned with the first end of the blade located on the concentric circle and the second end of the blade on the periphery of the face member is positioned forward of the first end by an acute angle.

4. The water pump in accordance with claim 3 wherein the second end of the plurality of straight blades on the periphery of the face member is positioned forward approximately 17 degrees of the first end on the concentric circle.

5. The water pump in accordance with claim 1 wherein the impeller threads onto the shaft is a first direction and the motor rotates the shaft in a direction opposite of the first direction.

6. The water pump in accordance with claim 1 wherein the motor housing includes a separation plate with the shaft extending through an opening into the coolant reservoir.

7. The water pump in accordance with claim 6 wherein the separation plate includes a sealing member positioned about the shaft to prevent coolant from entering the motor housing.

8. The water pump in accordance with claim 7 wherein the threaded portion of the impeller is a boss with internal threads for receiving the shaft having a sealing portion for mating with the sealing member and to prevent exposure of the shaft to coolant.

9. An operationally independent water pump for circulating coolant in a high performance engine having coolant passages, the water pump comprising:

an impeller having a face portion with a plurality of blades protruding perpendicular of the first side of the face portion having a boss with threads, the boss protruding from the face member on the opposite side;

a shaft having a threaded end for mating with a threaded portion of the impeller;

an electric motor in a motor housing and operatively connected to the shaft to cause rotation thereof;

an impeller housing and coolant reservoir coupled with the motor housing for containing the impeller and coolant;

an inlet in the impeller housing and coolant reservoir for receiving coolant from a first passageway;

an outlet in the impeller housing and coolant reservoir for sending coolant to a second passageway;

an inlet flange removably attached to the inlet of the impeller housing and coolant reservoir for communicating coolant from a first coolant passageway; and an outlet flange removably attached to the outlet in the impeller housing and coolant reservoir for communicating coolant to a second coolant passageway.

10. The water pump in accordance with claim 9 wherein the inlet flange and the outlet flange are mechanically fastened to the respective coolant reservoir inlet and outlet.

11. The water pump in accordance with claim 9 wherein multiple configurations of outlet and inlet flanges may be adapted to the respective inlet and outlet for mating with coolant passages of different sized engines.

* * * * *

UNITED STATES PATENT AND TRADEMARK OFFICE

CERTIFICATE OF CORRECTION

PATENT NO. : 6,491,494 B1 
DATED : December 10, 2002
INVENTOR(S) : Beckenbach et al.

It is certified that error appears in the above-identified patent and that said Letters Patent is hereby corrected as shown below:

Drawings,
The title page showing an illustrative figure, should be deleted and substitute therefor the attached title page.
Delete Figures 1-7B, and substitute therefor the Figures 1-7B, as shown on the attached pages.

Signed and Sealed this

Sixteenth Day of September, 2003

JAMES E. ROGAN
*Director of the United States Patent and Trademark Office*

(12) United States Patent
Beckenbach et al.

(10) Patent No.: US 6,491,494 B1
(45) Date of Patent: Dec. 10, 2002

(54) DIRECT DRIVE WATER PUMP

(76) Inventors: Clyde D. Beckenbach, 946 Macy St., West Palm Beach, FL (US) 33405; Rowland W. Wood, Jr., 16944 CR 252, McAlpin, FL (US) 32062

( * ) Notice: Subject to any disclaimer, the term of this patent is extended or adjusted under 35 U.S.C. 154(b) by 0 days.

(21) Appl. No.: 09/705,455

(22) Filed: Nov. 2, 2000

(51) Int. Cl.[7] ..... F01D 1/02
(52) U.S. Cl. ..... 415/206
(58) Field of Search ..... 415/191, 203, 415/204, 205, 206, 211.2, 230, 168.2; 416/185, 223 B

(56) References Cited

U.S. PATENT DOCUMENTS

RE24,909 E * 12/1960 Dochterman
5,205,725 A * 4/1993 Pattison ..... 417/423.3

* cited by examiner

*Primary Examiner*—Edward K. Look
*Assistant Examiner*—Kimya N McCoy
(74) *Attorney, Agent, or Firm*—Stokes Lawrence, P.S.

(57) ABSTRACT

A direct drive water pump is provided for circulating coolant in a high performance engine with or without a radiator. The direct drive water pump utilizes an electric motor that may be removed. The direct drive water pump utilizes removable flanges that provide for the use of the pump with multiple engines having various water passage configurations.

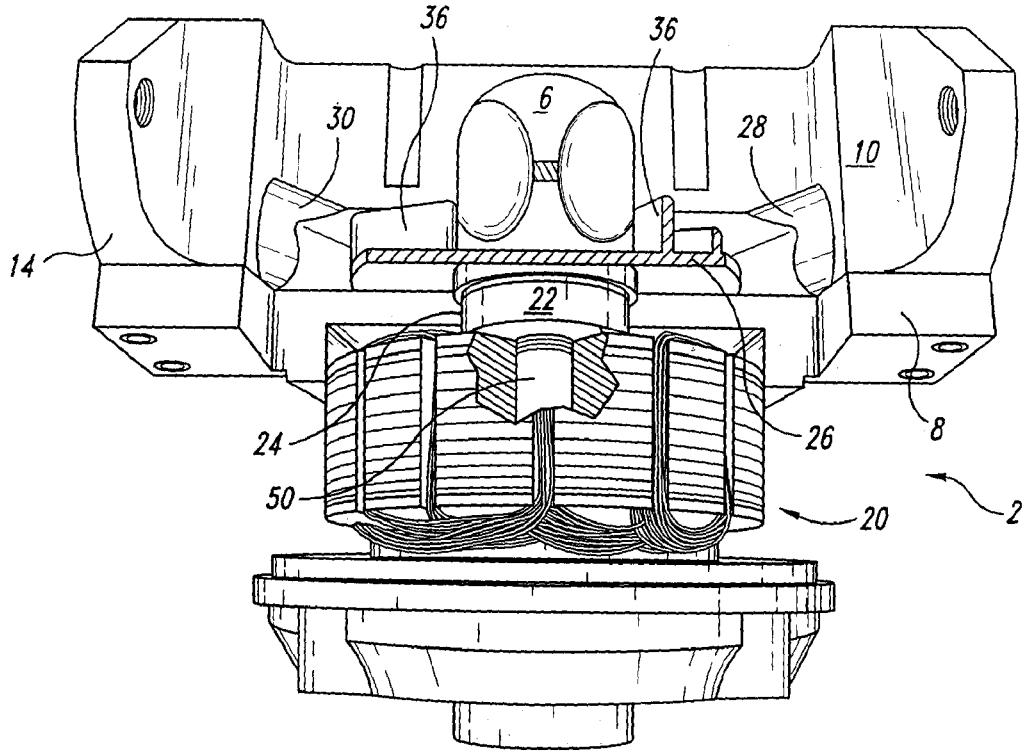

11 Claims, 4 Drawing Sheets